US005717286A

United States Patent [19]

Itoh et al.

[11] Patent Number: 5,717,286

[45] Date of Patent: Feb. 10, 1998

[54] ELECTRON EXCITED LUMINOUS ELEMENT WITH AN ANODE SUBSTRATE HAVING A GLASS EXPOSED SUBFACE PROVIDED WITH A HYDROPHOBIC PROPERTY

[75] Inventors: Shigeo Itoh; Teruo Watanabe; Tatsuo Yamaura; Takeshi Tonegawa; Takahiro Niiyama; Yuji Nomura, all of Mobara, Japan

[73] Assignee: Futaba Denshi Kogyo K.K., Mobara, Japan

[21] Appl. No.: 648,765

[22] Filed: May 16, 1996

[30] Foreign Application Priority Data

May 17, 1995 [JP] Japan ..... 7-141358
Jan. 26, 1996 [JP] Japan ..... 8-031199

[51] Int. Cl.[6] ..... H01J 1/62; H01J 29/10

[52] U.S. Cl. ..... 313/495; 313/466; 313/496

[58] Field of Search ..... 313/495, 461, 313/466, 473, 479, 496

[56] References Cited

U.S. PATENT DOCUMENTS

| | | | |
|---|---|---|---|
| 4,099,080 | 7/1978 | Dawson et al. | 313/116 |
| 5,189,341 | 2/1993 | Itoh et al. | 315/169.1 |
| 5,218,268 | 6/1993 | Matsuda et al. | 313/479 |
| 5,245,904 | 9/1993 | Van De Leest et al. | 313/479 |
| 5,256,936 | 10/1993 | Itoh et al. | 313/495 |
| 5,300,858 | 4/1994 | Nikaido | 313/503 |
| 5,381,069 | 1/1995 | Itoh et al. | 313/310 |
| 5,402,041 | 3/1995 | Kishino et al. | 315/169.1 |
| 5,469,014 | 11/1995 | Itoh et al. | 313/308 |
| 5,534,748 | 7/1996 | Oomen | 313/466 |

*Primary Examiner*—Sandra L. O'Shea
*Assistant Examiner*—Jay M. Patidar
*Attorney, Agent, or Firm*—Oblon, Spivak, McClelland, Maier & Neustadt, P.C.

[57] ABSTRACT

Electron excited luminous element capable of ensuring satisfactory emission characteristics of emitters for an extended period of time. A hydrophobic insulating film is formed on a glass anode substrate so as to cover an exposed portion thereof between anode electrodes. This keeps the glass anode substrate from being directly attacked by electrons, to thereby prevent decomposition of water and the like contained in a surface of the glass, resulting in oxygen which causes deterioration in emission characteristics of emitter cones being kept from being released from the glass.

32 Claims, 8 Drawing Sheets

ELECTRON EXCITED LUMINOUS ELEMENT WITH AN ANODE SUBSTRATE HAVING A GLASS EXPOSED SUBFACE PROVIDED WITH A HYDROPHOBIC PROPERTY

BACKGROUND OF THE INVENTION

This invention relates to an electron excited luminous element, and more particularly to an electron excited luminous element made of at least a cathode substrate provided thereon with an electron emission means for emitting electrons and an anode substrate formed thereon with anode electrodes and phosphor layers excited by electrons emitted from the electron emission means.

When an electric field which is set at a level of about $10^9$ V/m is applied to a surface of a metal material or that of a semiconductor material, a tunnel effect permits electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode".

Recent development of semiconductor processing techniques permits a field emission cathode (hereinafter also referred to as "FEC") of the surface emission type to be constructed of arrays of field emission cathode element having a size as small as microns.

Now, a display element utilizing a field emission cathode of the Spindt type which is an example of such a conventional field emission cathode will be described hereinafter with reference to FIG. 11.

A display element or display device shown in FIG. 11 includes a cathode substrate 103 on which cathode electrodes 109 are formed by deposition or the like. The cathode electrodes 109 each are formed thereon with emitters of a conical shape (hereinafter also referred to as "emitter cones") designated at reference numeral 114. Each of the cathode electrodes 109 is also formed thereon with a gate electrode 112 through an insulating layer 111 made of silicon dioxide ($SiO_2$). The gate electrode 112 and insulating layer 111 are formed with a plurality of through-holes 113 in a manner to be common to both. The emitter cones 114 each are arranged in each of the through-holes 113 in a manner to be exposed at a distal end thereof through the opening 113.

Fine processing techniques permit the emitter cones 114 to be arranged in a manner to be spaced from each other at pitches as small as 10 μm, so that tens of thousands to hundreds of thousands of such emitter cones 114 may be provided on one such cathode substrate 103.

Also, the techniques permit a distance between the gate electrode 112 and a distal end of each of the emitter cones 114 to be as small as less than a micron, so that application of a voltage as low as tens of volts between the gate electrode 112 and the cathode electrode 109 may permit electrons to be field-emitted from the emitter cones 114.

The conventional display element also includes a resistive layer 110 arranged between the cathode electrode 109 and the emitter cones 114 to stabilize operation of the display device.

Further, the conventional display element includes an anode substrate 102 arranged so as to be spaced at a predetermined interval from the cathode substrate 103 while being kept opposite thereto. The anode substrate 102 is provided on an inner surface thereof with a plurality of stripe-like anode electrodes 115, which have phosphor layers 116 deposited thereon.

Reference numeral 104 designates a side plate which is interposedly arranged between the anode substrate 102 and the cathode substrate 103 while being positioned at an outer periphery of each of both substrates, resulting in both substrates 102 and 103 being rendered opposite to each other at a predetermined interval. The anode substrate 102, cathode substrate 103 and side plate 104 thus arranged cooperate with each other to provide a vacuum airtight envelope, which is then evacuated to a high vacuum.

In the conventional display element thus constructed, when a voltage of a predetermined level is applied between the cathode electrode 109 and the gate electrode 112, electrons are field-emitted from a distal end of each of the emitter cones 114. The electrons thus field-emitted are attracted by the anode electrodes 115 having a positive voltage applied thereto, to thereby be impinged on the phosphor layers 116 formed on the anode electrodes 115. This results in the phosphor layers 116 being excited to exhibit luminescence.

The anode electrodes 115 each are made of a transparent material such as indium-tin oxide (ITO) or the like and the anode substrate 102 is made of glass, so that the luminescence may be observed through the anode substrate 102 and anode electrode 115.

The emitter cones 114 each are controlled so as to function as a picture cell unit, so that the phosphor layers 116 on the anode electrodes 115 may display an image desired.

Unfortunately, the conventional display element constructed as described above has a disadvantage of causing emission of electrons from the emitter cone 114 to be deteriorated in a short period of time, resulting in failing to provide increased durability or lifetime.

SUMMARY OF THE INVENTION

The present invention has been made in view of the foregoing disadvantage of the prior art.

Accordingly, it is an object of the present invention to provide an electron excited luminous element which is capable of ensuring that emitter cones exhibit satisfactory emission characteristics over an extended period of time.

In accordance with the present invention, an electron excited luminous element is provided. The luminous element includes a vacuum airtight envelope constructed of at least a cathode substrate made of glass and provided thereon with an electron emission means and an anode substrate made of glass and arranged opposite to the cathode substrate. The anode substrate is provided thereon with stripe-like anode electrodes, which are provided thereon with phosphor layers which are excited by electrons emitted from the electron emission means. The anode substrate has a glass exposed surface provided with a hydrophobic property.

In a preferred embodiment of the present invention, the hydrophobic property of the glass exposed surface of the anode substrate is provided by covering the glass exposed surface with a hydrophobic insulating film.

Also, in accordance with the present invention, an electron excited luminous element is provided. The luminous element includes a vacuum airtight envelope constructed of at least a cathode substrate made of glass and provided thereon with an electron emission means and an anode substrate made of glass and arranged opposite to the cathode substrate. The anode substrate is provided thereon with stripe-like anode electrodes. The stripe-like anode electrodes are provided thereon with phosphor layers which are excited by electrons emitted from the electron emission means. The anode substrate is provided at only a portion thereof in proximity to the anode electrodes and irradiated with electrons with a hydrophobic property.

In a preferred embodiment of the present invention, the hydrophobic property is provided by covering the portion of the anode substrate in proximity to the anode electrodes and irradiated with electrons with a hydrophobic insulating film.

Further, in accordance with the present invention, an electron excited luminous element is provided. The luminous element includes a vacuum airtight envelope constructed of at least a cathode substrate made of glass and provided thereon with an electron emission means and an anode substrate made of glass and arranged opposite to the cathode substrate. The anode substrate is provided thereon with stripe-like anode electrodes, which are provided thereon with phosphor layers which are excited by electrons emitted from the electron emission means. The anode substrate is provided at a portion thereof other than the phosphor layers with a hydrophobic property.

In a preferred embodiment of the present invention, the hydrophobic property is provided by covering the portion of the anode substrate other than the phosphor layers with a hydrophobic insulating film.

In addition, in accordance with the present invention, an electron excited luminous element is provided. The luminous element includes a vacuum airtight envelope constructed of at least a cathode substrate made of glass and provided thereon with an electron emission means and an anode substrate made of glass and arranged opposite to the cathode substrate. The anode substrate is provided thereon with stripe-like anode electrodes, which are provided thereon with phosphor layers which are excited by electrons emitted from the electron emission means. The anode substrate is provided at a portion thereof other than the phosphor layers which is positioned in proximity to the anode electrodes and irradiated with electrons with a hydrophobic property.

In a preferred embodiment of the present invention, the hydrophobic property is provided by covering the portion of the anode substrate other than the phosphor layers which is positioned in proximity to the anode electrodes and irradiated with electrons with a hydrophobic insulating film.

In a preferred embodiment of the present invention, the hydrophobic property is blackened.

Furthermore, in accordance with the present invention, an electron excited luminous element is provided. The luminous element includes a vacuum airtight envelope constructed of at least a cathode substrate made of glass and provided thereon with an electron emission means and an anode substrate made of glass and arranged opposite to the cathode substrate. The anode substrate is provided thereon with stripe-like anode electrodes, which are provided thereon with phosphor layers which are excited by electrons emitted from the electron emission means. The vacuum airtight envelope is provided on an inner surface thereof other than the anode substrate and irradiated with electrons with a hydrophobic property.

In a preferred embodiment of the present invention, the inner surface of the vacuum airtight envelope other than the anode substrate and irradiated with electrons is covered with a hydrophobic insulating film, resulting in the hydrophobic property being provided.

In a preferred embodiment of the present invention, the hydrophobic insulating film is made of a material selected from the group consisting of a nitride and a mixture containing at least a nitride.

In a preferred embodiment of the present invention, the hydrophobic insulating film is made of a material selected from the group consisting of a carbide and a mixture containing at least a carbide.

In a preferred embodiment of the present invention, the hydrophobic insulating film is made of a material selected from the group consisting of a fluoride and a mixture containing at least a fluoride.

In a preferred embodiment of the present invention, the hydrophobic insulating film has an internal layer arranged between the portion of the envelope to be provided thereon with the hydrophobic insulating film and the hydrophobic insulating film. The internal layer is made of a material exhibiting affinity for both the portion of the envelope and the hydrophobic insulating layer.

In a preferred embodiment of the present invention, the hydrophobic insulating film is made of a mixture containing at least a nitrogen compound.

In a preferred embodiment of the present invention, the internal layer is made of an oxide of a material used for the hydrophobic insulating film.

In a preferred embodiment of the present invention, the hydrophobic insulating film is constructed into a layer structure wherein a content of a material exhibiting affinity for the portion of the envelope to be provided with the hydrophobic insulating film is decreased from an inner layer of the hydrophobic insulating film toward a surface thereof.

In a preferred embodiment of the present invention, the hydrophobic insulating layer is made of a mixture containing at least a nitrogen compound.

In a preferred embodiment of the present invention, the hydrophobic insulating layer contains at least an oxygen component, resulting in exhibiting affinity for the portion of the envelope to be provided with the hydrophobic insulating film.

In a preferred embodiment of the present invention, the hydrophobic insulating film is formed by vapor phase growth.

In a preferred embodiment of the present invention, the hydrophobic insulating film is provided on a black matrix.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
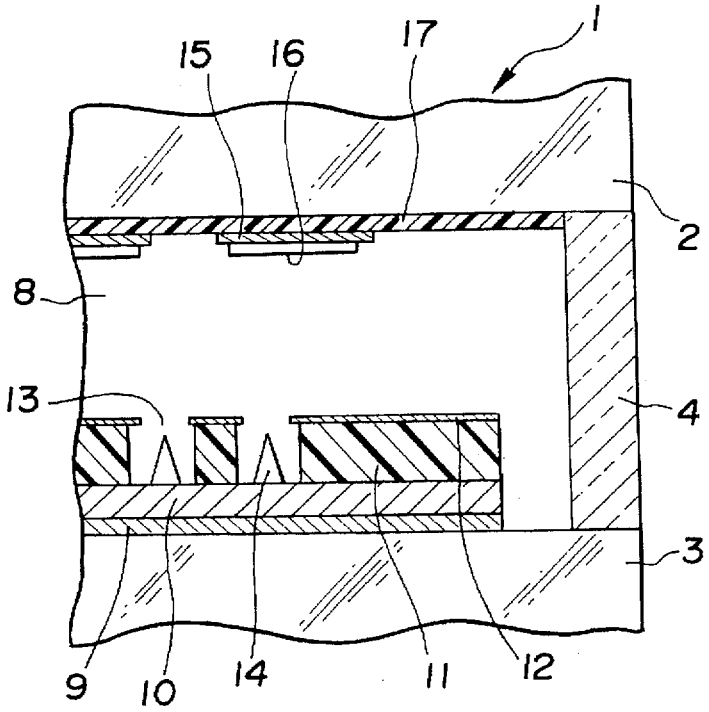
FIG. 1 is a fragmentary vertically sectional view showing an essential part of a display device which is a first embodiment of an electron excited luminous element according to the present invention.

Now, an electron excited luminous element according to the present invention will be described hereinafter with reference to FIGS. 1 to 10, in which like reference numerals designate like or corresponding parts throughout.

An electron excited luminous element of the present invention includes a luminous element excited by electrons, as well as a display element constructed of a luminous element excited by electrons.

First, the circumstances of the present invention will be described prior to description of construction of the present invention.

Figure 10:
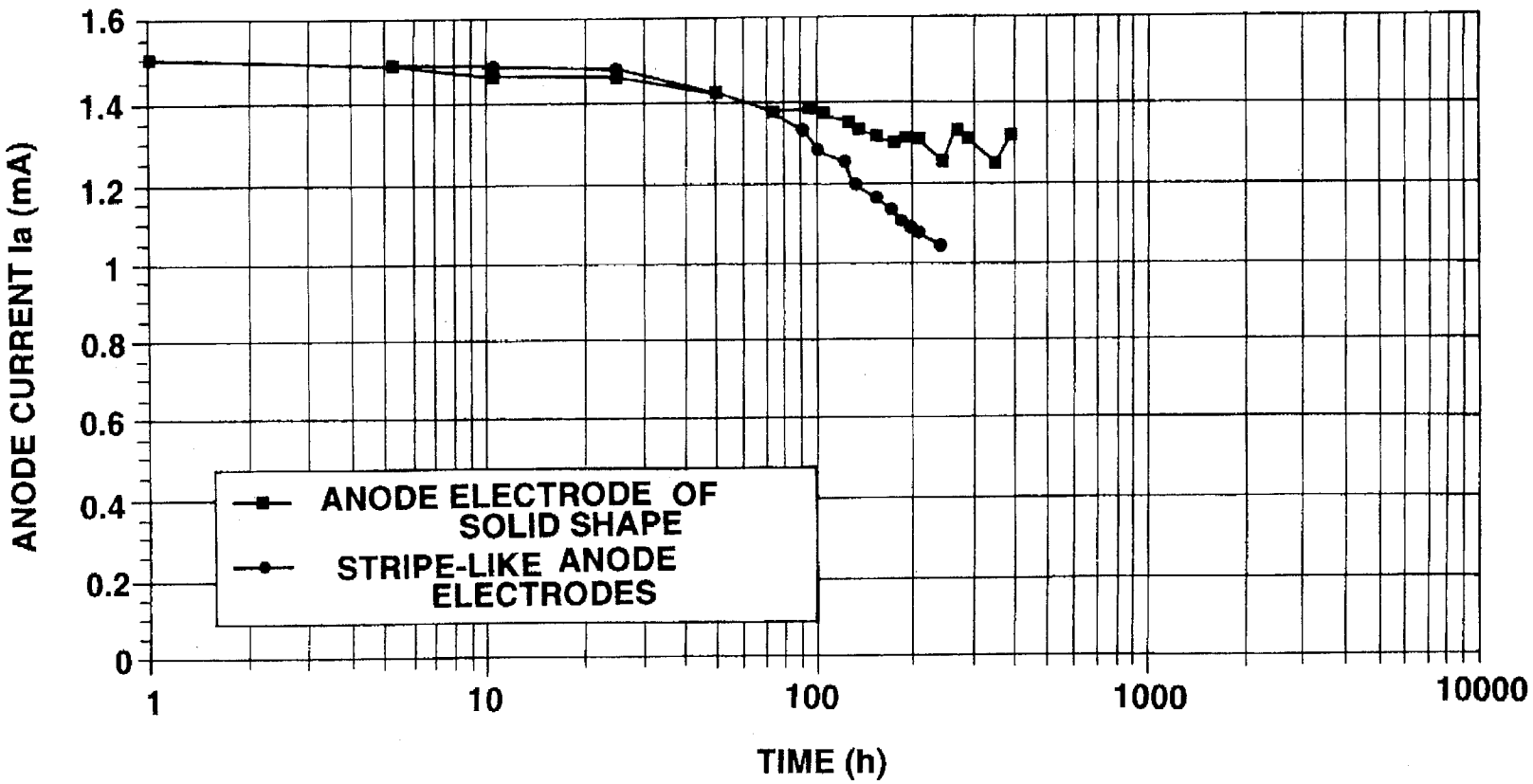
FIG. 10 is a graphical representation showing emission characteristics of each of a display device in which stripe-like anode electrodes are incorporated and that in which an anode electrode of a solid shape is incorporated.
Figure 11:
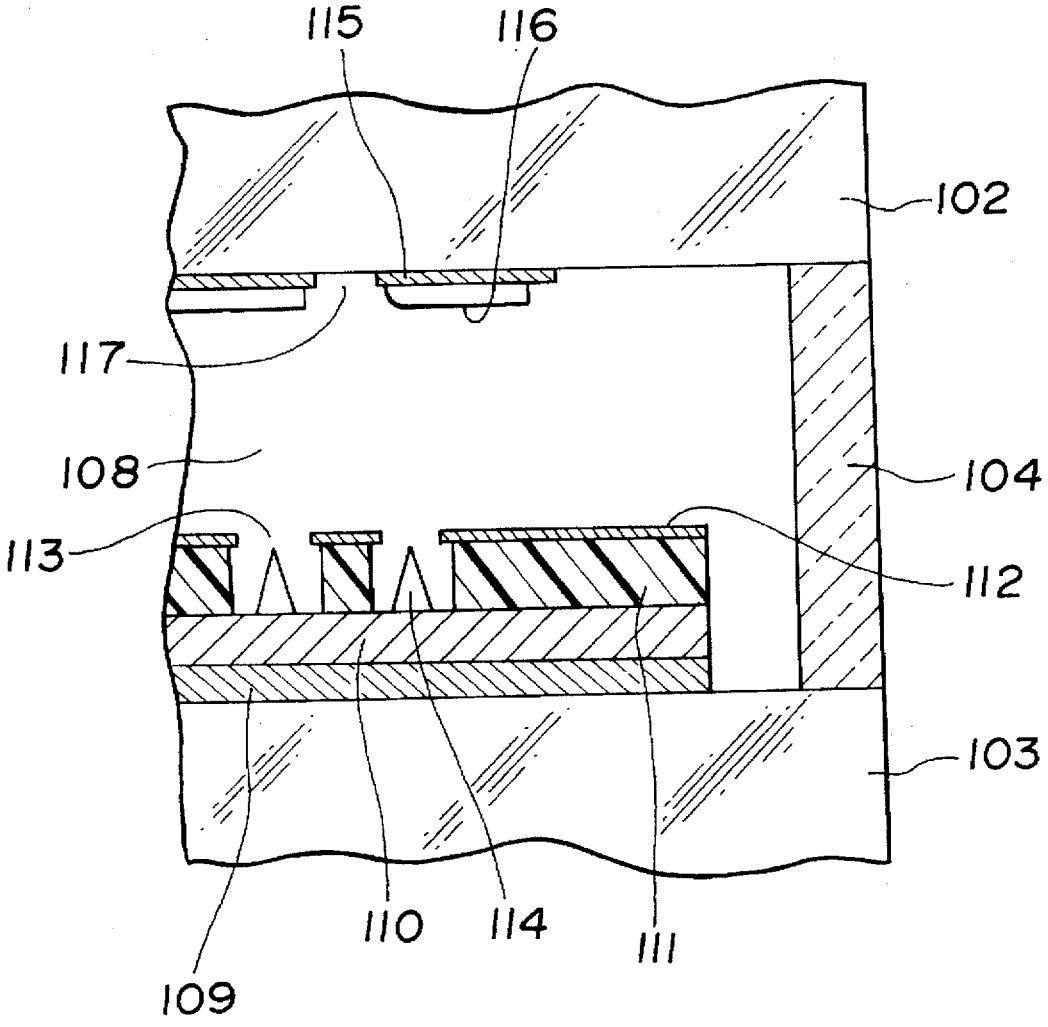
FIG.11 (PRIOR ART)
FIG. 11 is a fragmentary vertical sectional view showing a conventional display device.

The display element having the stripe-like anode electrodes incorporated therein which is constructed as described above with reference to FIG. 11 exhibits such a lifetime as represented by emission characteristics indicated at black circular dots in FIG. 10, wherein an anode current $Ia$ is highly decreased. This indicates that the display element causes emission of the emitter cones to be deteriorated in a short period of time.

The inventors found the fact that a lifetime of a display element generally depends on a structure of the display element and a display element including an anode electrode formed into a solid shape exhibits an increased lifetime as indicated at black square dots in FIG. 10, as compared with that including stripe-like anode electrodes.

Now, the fact thus found will be more detailedly described with reference to FIG. 8, which shows results of analysis of gas discharged from an anode substrate set in a high vacuum chamber when the anode substrate is irradiated with electrons, wherein "FEC" indicates an anode substrate set for measuring a background without feeding anode electrodes with a current, "ITO of Solid Shape" indicates an anode substrate on which an anode electrode of ITO is formed into a solid shape, "ITO at intervals of 80 μm" indicates an anode substrate on which stripe-like anodes are arranged so as to be spaced at intervals of 60 μm from each other, and "ITO at intervals of 160 μm" indicates an anode substrate on which stripe-like anodes are arranged so as to be spaced at intervals of 160 μm from each other.

Figure 4:
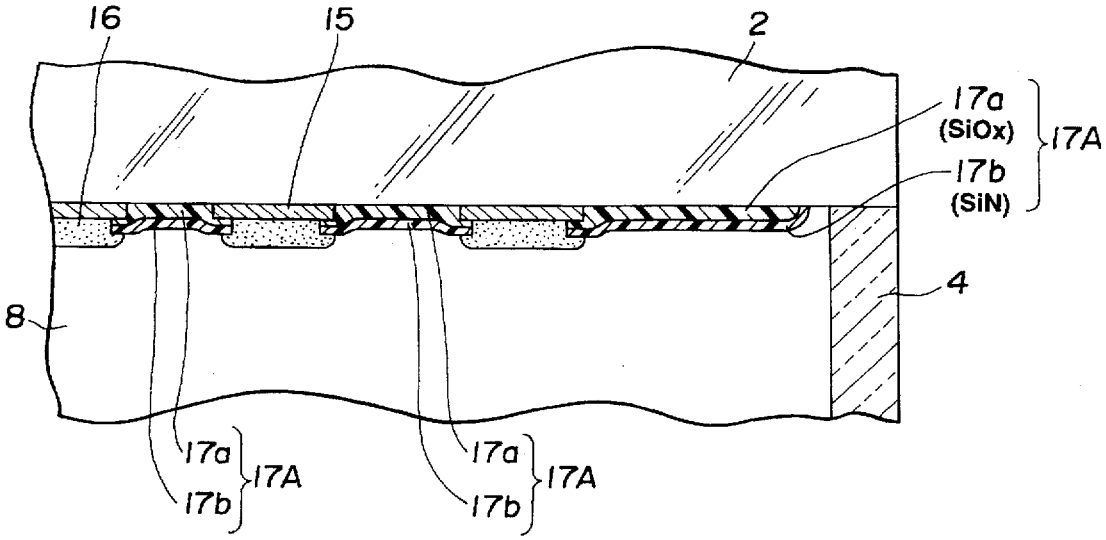
FIG. 4 is a fragmentary vertically sectional view showing an essential part of a display device which is a fourth embodiment of an electron excited luminous element according to the present invention.
Figure 8:
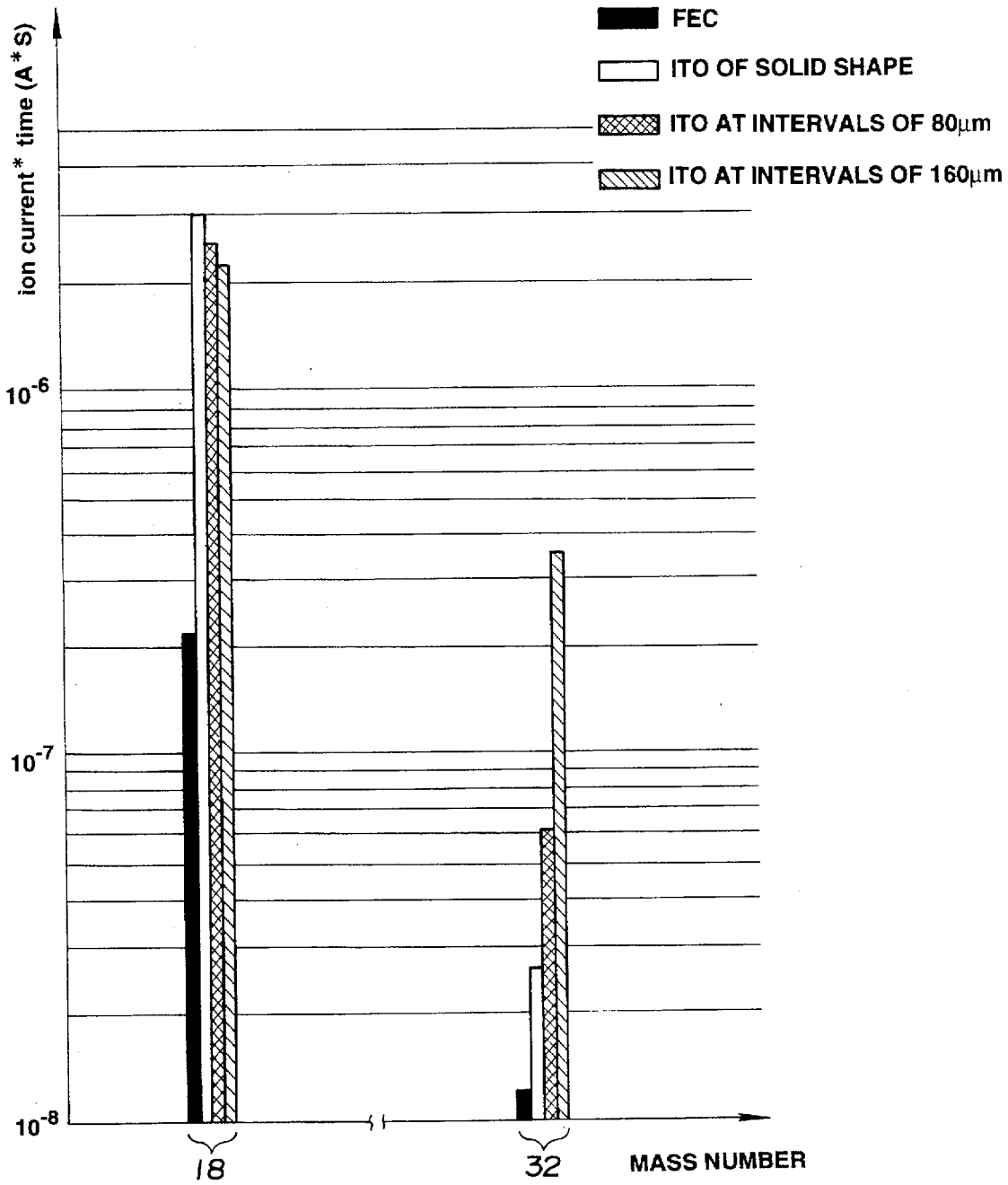
FIG. 8 is a graphical representation showing results of analysis of gas discharged from an anode substrate set in a high vacuum chamber when the anode substrate is irradiated with electrons.

The anode substrates each have peaks appearing at various mass numbers, however, FIG. 8 shows only peaks appearing at mass numbers 18 and 32 for the sake of brevity. The peaks appearing at the mass numbers 18 and 32 are considered to be water ($H_2O$) and oxygen ($O_2$). FIG. 4 indicates that in the display element, water at mass number 18 is decreased with an increase in interval between the anode electrodes or with an increase in area of a glass exposed surface of the anode substrate, whereas oxygen at mass number 18 is rapidly increased with an increase in area of the glass exposed surface.

Also, it was previously confirmed that certain specific gas adversely affects emission characteristics of a field emission emitter. Also, it was confirmed that the specific gas includes oxygen ($O_2$). Thus, it would be supposed that an increase in oxygen ($O_2$) appearing at mass number 32 causes a decrease in lifetime of the emitter.

In view of the foregoing, the decrease in water or moisture and the increase in oxygen were considered and, as a result, it would appear that these are caused due to production of oxygen by decomposition of water. This would be understood for the following reasons. More particularly, when the display device is not subject to baking, gas remaining in the vacuum airtight envelope contains lots of water or moisture and oxygen; whereas baking of the display device causes a decrease in moisture in the envelope, as well as a decrease in oxygen. Thus, the inventors concluded that oxygen occurs due to decomposition of water.

Now, reasons why oxygen is increased with an increase in exposed area of the anode substrate will be considered. The anode substrate is made of glass, of which a surface is changed in properties by water and/or gas contained in an atmosphere in the envelope, resulting in a denatured layer being formed on the surface. The denatured layer contains water and/or has water adsorbed thereon, so that moisture accounts for the largest part of gas in the glass.

The glass surface is also formed thereon with a hydration layer rich in $SiO_2$. The hydration layer is apt to crack at a low temperature, leading to hydration of a Si—O—Si network and a reaction $Si—O—Si+H_2O \rightarrow Si—OH+HO—Si$, followed by reorganization of the structure due to dehydration and condensation represented by a reaction $2SiOH \rightarrow Si—O—Si+H_2O$. Then, the structure thus reorganized is hit by electrons and a surface current or the like occurs on the glass exposed surface of the anode substrate defined between the ITO anode electrodes, so that $H_2O$ in residual gas is adsorbed on the glass exposed surface, followed by decomposition of the $H_2O$ into $OH^-$ and $H^+$, leading to discharge of $O_2$ gas from the glass exposed surface.

The present invention has been made while taking notice of the fact described above.

Now, an electron excited luminous element of the present invention will be described hereinafter in connection with embodiments thereof which are practiced in the form of a display element or display device.

Referring first to FIG. 1, a first embodiment of an electron excited luminous element according to the present invention is illustrated. A luminous element or display element of the illustrated embodiment generally designated by reference numeral 1 includes an anode substrate 2 made of glass on which transparent glass anode electrodes 15 and phosphor layers 16 are formed, as well as a cathode substrate 3 on which an electron emission means is formed. The electron emission means is constructed of cathode electrodes 9, resistive layers 10, insulating layers 11, gate electrodes 12 and emitter clones 14. The display element 1 also includes a side plate 4 arranged between the anode substrate 2 and the cathode substrate 3 so as to space both substrates 2 and 3 at a predetermined interval from each other while keeping them opposite to each other. The anode substrate 2, cathode substrate 3 and side plate 4 cooperate with each other to form an airtight envelope, which is then evacuated to a high vacuum, resulting in an interior or inner space 8 of a high vacuum atmosphere being formed therein. The gate electrode 12 and insulating layer 11 are formed with a plurality of through-holes 13 in a manner to be common to both. The emitter cones 14 are arranged in the through-holes 13, respectively.

Reference numeral 17 designates a hydrophobic insulating film.

The display element of the illustrated embodiment is featured in that the hydrophobic insulating film 17 is formed on an inner surface of the glass anode substrate 2 so as to extend over the whole inner surface, on which the stripe-like anode electrodes 15 and phosphors 16 are arranged.

Such a featured construction of the illustrated embodiment permits any glass exposed surface to be eliminated from the anode substrate 2. Thus, when a voltage of a predetermined level is applied between each of the cathode electrodes 9 and each of the gate electrodes 12 to cause electrons to be field-emitted from the emitter cones 14, the electrons are attracted by the anode electrodes 15 having a positive voltage applied thereto. However, field-emission of the electrons is carried out while keeping the electrons spread at an angle of about 60 degrees, resulting in the electrons being irradiated on a portion of the anode substrate between the anode electrodes 15 as well as on the anode electrodes.

If any glass exposed surface remains on the anode substrate or exists on the portion of the anode substrate between the transparent anode electrodes 15 as in the prior art described above, oxygen gas is caused to be discharged from the glass exposed surface. On the contrary, the display element of the illustrated embodiment is so constructed that the hydrophobic insulating film 17 is formed on the whole glass surface of the anode substrate 2 to prevent glass from being exposed from the anode substrate. Thus, the electrons are irradiated on the hydrophobic insulating film 17 rather than the glass exposed surface. The hydrophobic insulating film 17 inherently prevents water from being adsorbed thereon, so that irradiation of electrons on the hydrophobic insulating film 17 does not cause discharge of oxygen gas due to decomposition of water.

Figure 9:
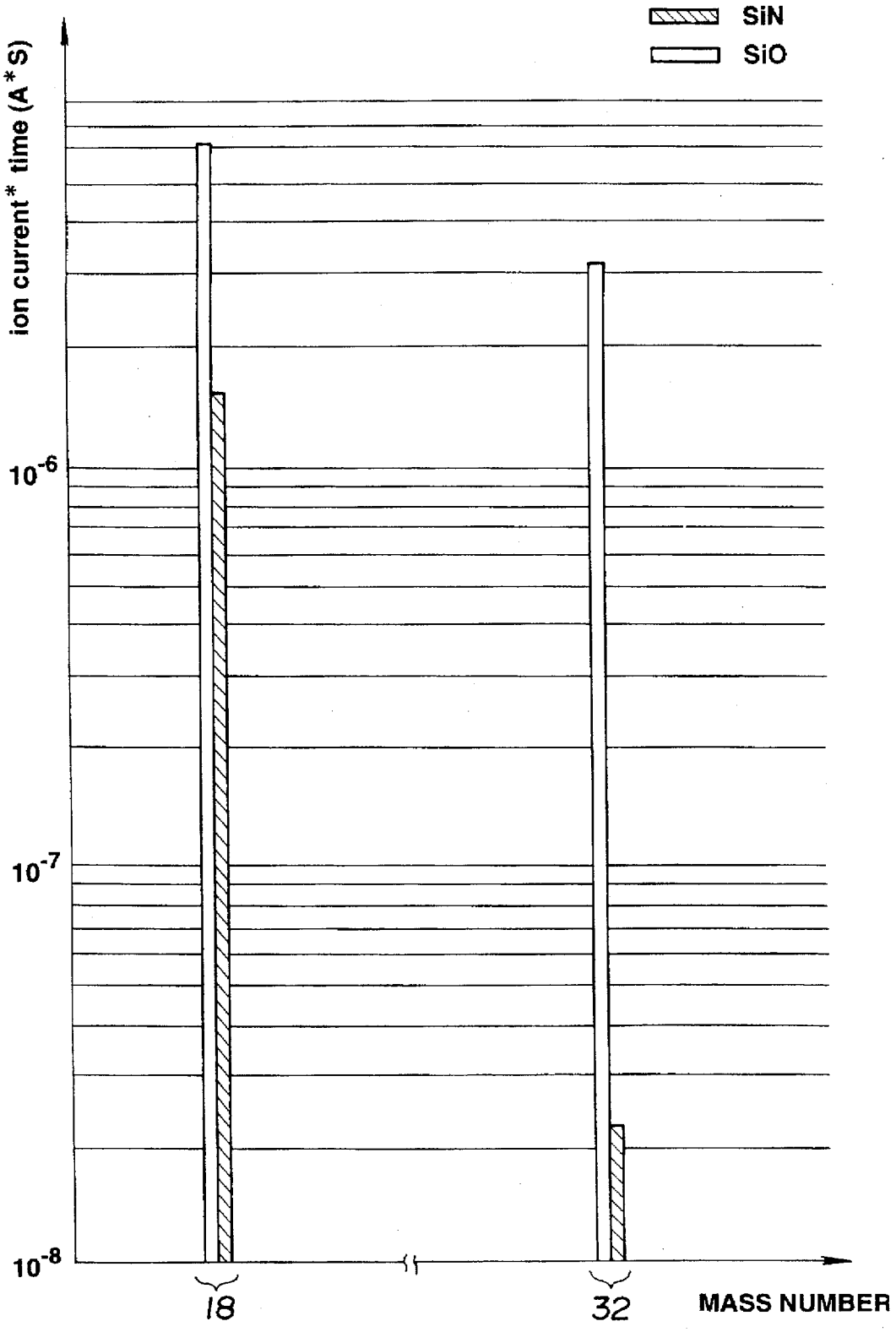
FIG. 9 is a graphical representation showing results of analysis of gas discharged from an anode substrate set in a high vacuum chamber and formed thereon with insulating film when the anode substrate is irradiated with electrons.

Now, such a function of the illustrated embodiment as described above will be further described hereinafter with reference to FIG. 9, which shows results of analysis of gas discharged from an anode substrate set in a high vacuum chamber and formed thereon with an insulating film when the anode substrate is irradiated with electrons. In FIG. 9, "SIN" indicates an insulating film 17 made of silicon nitride (SIN) exhibiting a hydrophobic property and "SiO" indicates an insulating film made of silicon dioxide ($SiO_2$) exhibiting a hydrophilic property.

As shown in FIG. 9, a peak of water appearing at mass number 14 in the hydrophobic silicon nitride is only a fraction of that in the hydrophilic silicon oxide. Also, it indicates that a peak of oxygen appearing at mass number 32 in the hydrophilic silicon nitride is about one hundredth of that in the hydrophilic silicon oxide. Thus, it will be noted that the display element of the illustrated embodiment exhibits an increased lifetime or durability as compared with the prior art.

Now, manufacturing of the display element shown in FIG. 1 will be described hereinafter. First, the anode substrate 2 made of glass is formed on a surface thereof with a $Si_xN_y$ film and a film of a nitride such as AlN, BN or the like for the hydrophobic insulating film 17. The $Si_xN_y$ film is formed by plasma CVD techniques using $SiH_4$ and $NH_3$ as gas species or by reactive sputtering techniques using $N_2$ as carrier gas while using SiN as a target. The nitride film is formed by sputtering. The hydrophobic insulating film 17 is formed into a thickness of, for example, about 0.1 μm. Then, an ITO film for the transparent anode electrodes 15 is formed into a thickness of 0.05 to 0.1 μm on the hydrophobic insulating film 17 by sputtering or EB deposition and then subject to photolithography or etching, resulting in being patterned into a stripe-like shape, to thereby provide the stripe-like anode electrodes 15. Then, the phosphors 16 are formed on the anode electrodes 15 by slurry techniques or electro-deposition.

Also, the cathode electrodes 9 each are formed of Nb, W, Mo or the like into a thickness of, for example, 0.4 μm on the cathode substrate by sputtering and then the resistive layer 10 is formed into a thickness of, for example, 1.0 μm on each of the cathode electrodes 9 by CVD techniques. Then, the gate electrodes 12 each are formed of Nb into a thickness, for example, 0.4 μm by sputtering.

Subsequently, the gate electrodes 12 are subject to dry etching using $SF_6$ or the like, to thereby be formed with the through-holes 13, followed by formation of an Al release layer by oblique deposition. Then, Mo for emitter cones 14 is formed on the release layer by positive deposition and then the release layer is removed by wet etching, so that the emitter cones 14 may be arranged in the through-holes 13, resulting in the cathode substrate 3 being provided.

Thereafter, the anode substrate 2 and cathode substrate 3 are sealedly joined to each other by means of sealing glass with the side plate 4 being interposed therebetween, resulting in the airtight envelope, of which the inner space 8 is then evacuated to a high vacuum. Then, an evacuation hole (not shown) is sealed, to thereby provide the display element 1.

Figure 2:
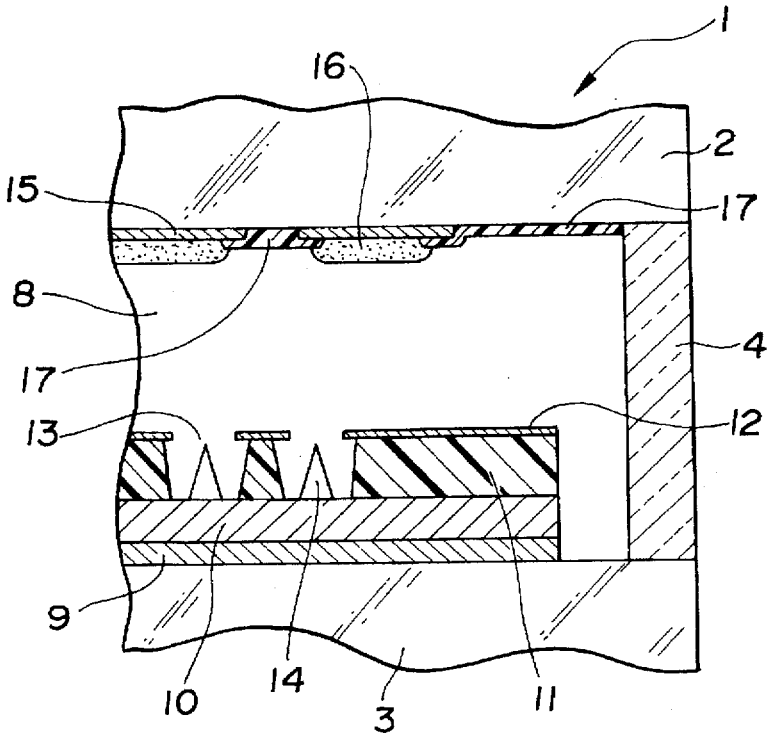
FIG. 2 is a fragmentary vertically sectional view showing an essential part of a display device which is a second embodiment of an electron excited luminous element according to the present invention.

Referring now to FIG. 2, a second embodiment of a luminous element according to the present invention is illustrated, which is likewise in the form of a display element. A display element of the second embodiment is constructed in substantially the same manner as the first embodiment described above, except arrangement of a hydrophobic insulating layer 17. More specifically, in the second embodiment, the hydrophobic insulating layer 17 is arranged so as to cover an exposed surface portion of a glass anode substrate 2 defined between stripe-like anode electrodes 15.

In this instance, the hydrophobic insulating film 17 may be arranged on a portion of the anode substrate 2 which is other than phosphor layers 16 and on which electrons emitted from the emitter cones 14 are irradiated. Also, the hydrophobic insulating layer 17 may contain any pigment or have any mixture added thereto so that a portion of the anode substrate 2 other than a luminous region thereof may act as a black matrix to improve contrast of luminous display obtained by the display element. Alternatively, for the same purpose, the hydrophobic insulating film 17 may be subject to a surface treatment for blackening of the film 17.

Figure 3:
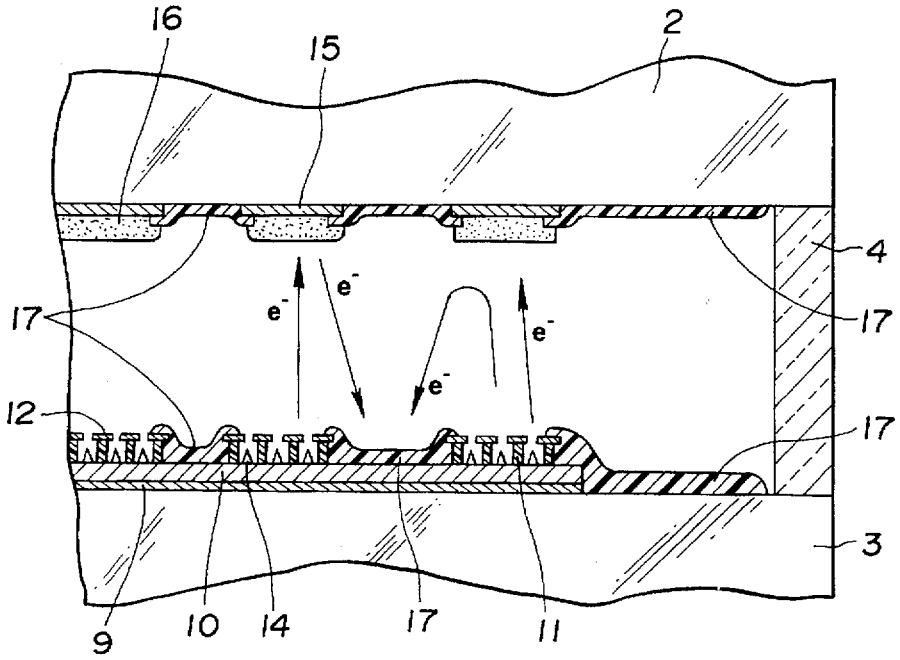
FIG. 3 is a fragmentary vertically sectional view showing an essential part of a display device which is a third embodiment of an electron excited luminous element according to the present invention.

Referring now to FIG. 3, a third embodiment of a luminous element according to the present invention is illustrated, which is likewise in the form of a display element or device. A display element of the third embodiment may be constructed in substantially the same manner as the second embodiment except arrangement of a hydrophobic insulating film 17. More specifically, in the third embodiment, the hydrophobic insulating film 17 is arranged on an anode substrate 2, as well as on a cathode substrate 3.

Such arrangement of the hydrophobic insulating film 17 effectively prevents discharge of oxygen gas from the cathode substrate 3 due to impingement, on the cathode substrate, of secondary electrons which are emitted from the anode substrate as shown in FIG. 3 when electrons emitted from emitter cones 14 impinged on the anode substrate 2. A part of electrons emitted from the emitter cones 14 acts as recoil electrons, which return toward the cathode substrate 3, to thereby be impinged on the cathode substrate 3, resulting in oxygen gas being discharged from the cathode substrate 3. Arrangement of the hydrophobic insulating film 17 on the cathode substrate 3 effectively prevents such emission of electrons from the cathode substrate 3.

In the illustrated embodiment, the hydrophobic insulating film 17 may be coated on an inner surface of a side plate 4. Preferably, arrangement of the hydrophobic insulating film 17 is so carried out that it is kept from being applied to seal glass containing PbO used for sealedly joining the side plate 4 to the substrates 2 and 3. Otherwise, the hydrophobic insulating film 17 adversely affects the seal glass.

Thus, it will be noted that the display element of the third embodiment is so constructed that the anode substrate 2, as well as a portion of an envelope including the cathode substrate 3 on which electrons are impinged exhibits a hydrophobic property.

In each of the embodiments described above, the hydrophobic insulating film 17 may be made of a nitride such as $Si_xN_y$, AlN or BN, a carbide such as SiC, AlC, BC, WC or TiC, a fluoride, or any mixture containing at least one thereof. The hydrophobic insulating film 17 may be formed by deposition using CVD reactive sputtering, ion plating or the like.

Also, in each of the embodiments described above, the hydrophobic insulating layer 17 provides the anode substrate 2 and the like with a hydrophobic property. The hydrophobic property may be provided directly on the anode substrate and the like by subjecting them to any suitable chemical treatment or any suitable physical treatment such as ion implantation or the like.

Such arrangement of the hydrophobic insulating film as in each of the first to third embodiments causes the hydrophobic insulating film to be decreased in affinity for glass of each of the anode substrate 2 and cathode substrate 3 depending on a material for the hydrophobic insulating film. This causes the hydrophobic insulating layer to fail to exhibit satisfactory adhesion or bond strength with respect to the glass substrates, leading to possible peel or release of the hydrophobic insulating film from the glass substrates.

Such a disadvantage phenomenon does not substantially cause any problem when the hydrophobic insulating film 17 is formed into a solid shape on the glass anode substrate 2 as in the first embodiment described above, because formation of the film 17 into a solid shape significantly increases a contact area between the glass substrate 2 and the hydrophobic insulating film 17. However, it fails to permit the hydrophobic insulating film 17 to exhibit sufficient bond strength when the hydrophobic insulating film is deposited on the glass exposed surface portion of the anode substrate defined between the stripe-like anode electrodes 15 as in the second or third embodiment, because such deposition or formation of the film decreases the contact area. This causes the hydrophobic insulating film to be peeled or released from the glass substrate.

Referring now to FIG. 4, a fourth embodiment of a luminous element according to the present invention is illustrated, which is constructed so as to substantially prevent such peel or release of a hydrophobic insulating film from a glass substrate as indicated above.

In a luminous element or display element of the fourth embodiment, a hydrophobic insulating film 17A is constructed into a two-layer structure. For this purpose, a $SiO_x$ layer 17*a* is first formed on an exposed surface of a glass anode substrate 2 and then a SiN layer 17*b* of hydrophobic and insulating properties is deposited thereon so as to cover the $SiO_x$ layer 17*b*.

Thus, the $SiO_x$ layer 17*a* is interposedly arranged between the anode substrate 2 and the SiN layer 17*b*, to thereby function as a buffer layer, resulting in exhibiting suitable affinity for both glass anode substrate 2 and SiN layer 17*b*. Such interposition of the inner layer or $SiO_x$ layer 17*a* ensures satisfactory bond strength between the hydrophobic insulating film 17A and the anode substrate 2, to thereby minimize release of the film 17A from the anode substrate 2.

Figure 5:
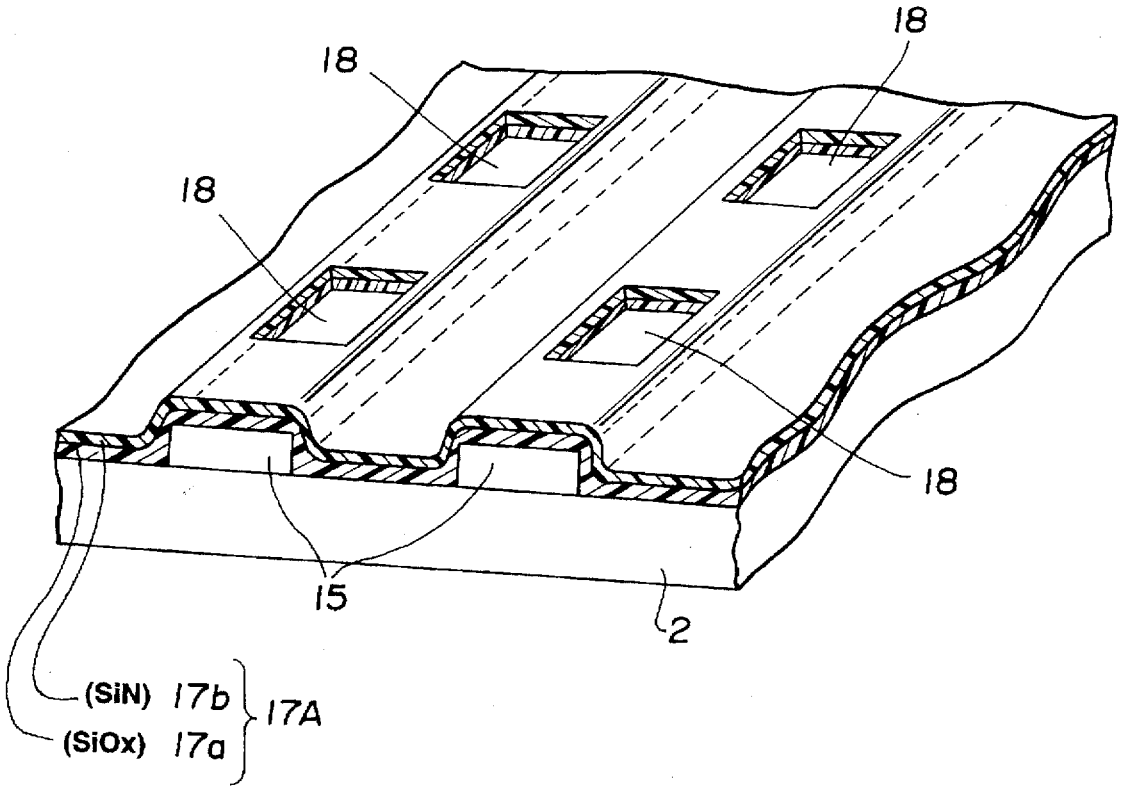
FIG. 5 is fragmentary perspective view showing formation of a hydrophobic insulating film in the electron excited luminous element shown in FIG. 4.

Now, formation of the display device of the fourth embodiment having the anode substrate 2 thus formed will be described hereinafter with reference to FIG. 5. First, the anode substrate 2 is formed thereon with stripe-like anode electrodes 15 in such a manner as described above. Then, the anode substrate 2 thus formed with the anode electrodes 15 is anode substrate 2 thus formed with the anode electrodes 15 is formed thereon with the $SiO_x$ layer 17*a* in a solid-like manner, followed by formation of the SiN layer 17*b* of a solid like shape on the $SiO_x$ layer 17*a*. Such formation of the $SiO_x$ layer 17*a* and SiN layer 17*b* into a solid like shape may be carried out by roll coating.

Subsequently, the hydrophobic insulating film 17A is subject to etching, resulting in being formed at a predetermined portion thereof with windows 18 in which phosphors 16 are arranged, so that the anode substrate 15 may be partially exposed. Thereafter, the phosphor windows 18 each are provided therein with the phosphor layer 16, resulting in such a layer structure as shown in FIG. 5 being formed on the anode substrate 2.

The remaining part of the display device of the fourth embodiment may be constructed in substantially the same manner as each of the first to third embodiments.

Figure 6:
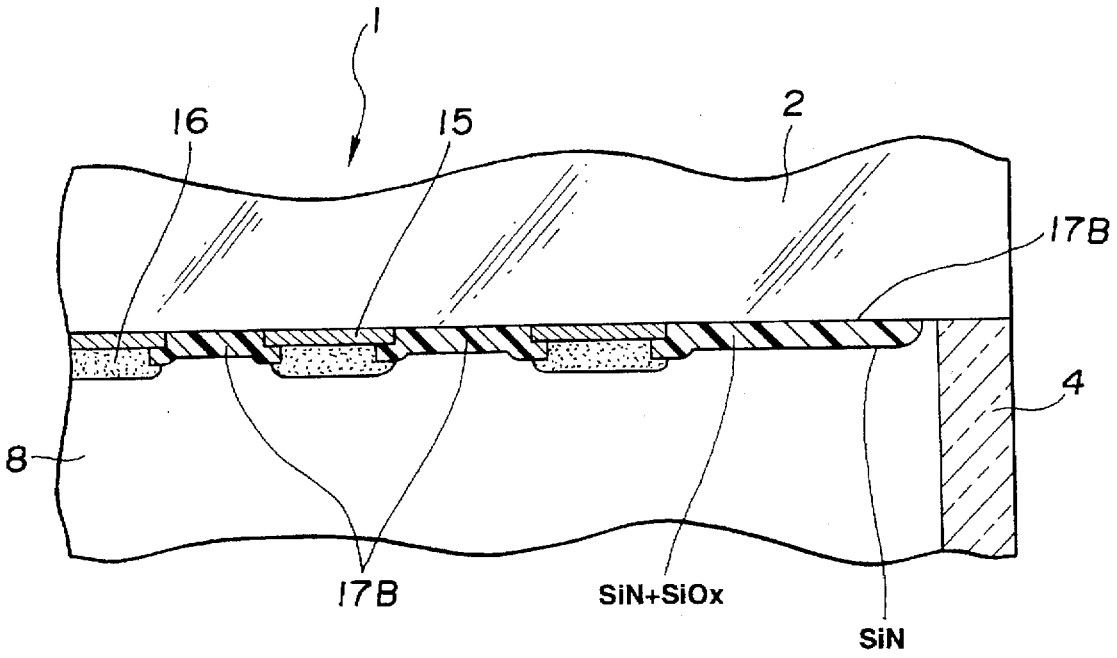
FIG. 6 is a fragmentary vertically sectional view showing an essential part of a display device which is a fifth embodiment of an electron excited luminous element according to the present invention.

Referring now to FIG. 6, a fifth embodiment of a luminous element according to the present invention is illustrated. A luminous element or display element of the fifth embodiment is constructed in substantially the same manner as the embodiment shown in FIG. 4, except that a hydrophobic insulating film 17B is arranged on a glass exposed surface of an anode substrate 2.

Formation of the hydrophobic insulating film 17B may be carried out by, for example, chemical vapor deposition (CVD). In an initial stage of the formation, gas having an oxygen component incorporated therein at a predetermined ratio to SiN is used to form a SiN+Si layer directly on the anode substrate 2. Then, formation of the layer by CVD is continued while gradually reducing the oxygen content in the gas, resulting in the layer finally formed thereon being made of only SiN completely free of oxygen. Thus, the hydrophobic insulating film 17B has the SiN+Si0 layer formed on a surface of the anode substrate, which is then gradually changed to the SiN layer toward a surface of the hydrophobic insulating film 17B, resulting in being in the form of a graded layer.

The hydrophobic insulating layer 17B thus formed permits the SiO layer which satisfactorily exhibits affinity for both anode substrate 2 and SiN layer to be interposed therebetween, to thereby minimize peel or release of the hydrophobic insulating layer 17B from the anode substrate 2.

The remaining part of the fifth embodiment may be constructed in substantially the same manner as the fourth embodiment described above with reference to FIG. 4.

Figure 7:
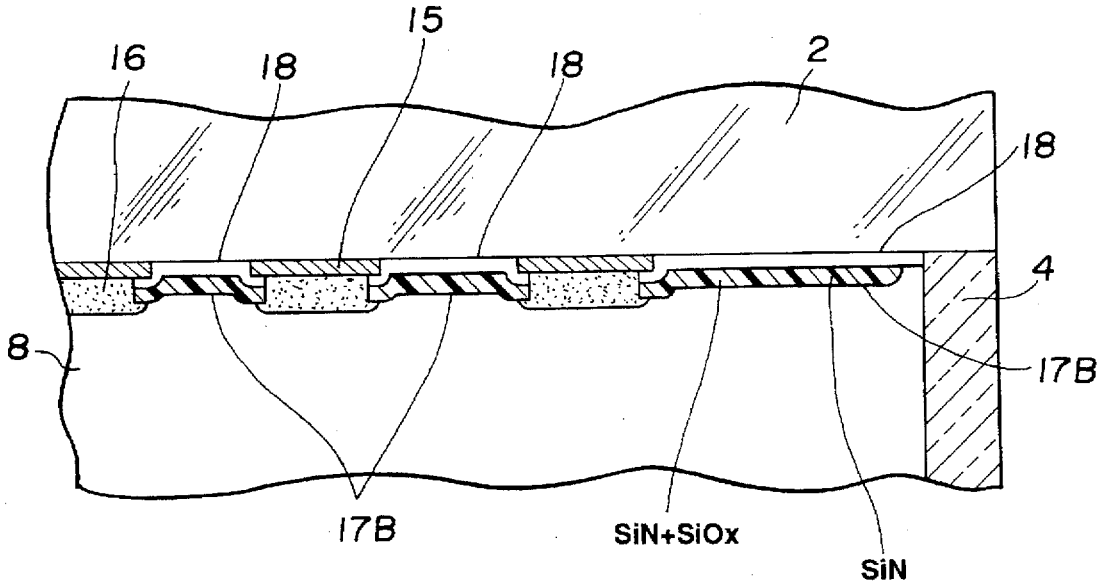
FIG. 7 is a fragmentary vertically sectional view showing an essential part of a display device which is a sixth embodiment of an electron excited luminous element according to the present invention.

Referring now to FIG. 7, a sixth embodiment of a luminous element according to the present invention is illustrated. A luminous element or display element of the illustrated embodiment is so constructed that a black mask 18 is arranged on a glass exposed surface portion of an anode substrate 2 between anode electrodes 15 patterned. The black mask 18 may be made of a Si oxide compound, a Cr oxide compound or the like, to thereby contribute to an improvement in contrast of an image displayed.

In the illustrated embodiment, the black mask 18 is formed thereon with the same hydrophobic insulating film 17B as that in fifth embodiment shown in FIG. 6. This results in the hydrophobic insulating film 17B likewise minimizing release of the film 17B from the black mask 18.

In the illustrated embodiment, as described above, the hydrophobic insulating film 17B is formed on the black mask 18. Alternatively, the hydrophobic insulating film 17B may be constructed into a two-layer structure like the hydrophobic insulating layer 17A in the fourth embodiment of FIG. 4.

The fourth to sixth embodiments described above each are so constructed that the anode substrate is formed on a side thereof on which the anode electrodes 15 are arranged in a predetermined pattern with the hydrophobic insulating film 17A or 17B. Alternatively, the hydrophobic insulating film 17A or 17B may be arranged in a solid manner on the anode substrate 2 as in the first embodiment shown in FIG. 1. Such arrangement of the film likewise increases bond strength of the hydrophobic insulating film. Also, the hydrophobic insulating film 17A or 17B may be arranged on an exposed surface of the cathode substrate 3 opposite to the anode substrate 2.

Further, in each of the fourth to sixth embodiments, the hydrophobic insulating film 17A or 17B is made of SiN and its oxide $SiO_x$ or $SiN+SiO_x$. Alternatively, the hydrophobic insulating film may be made of any suitable Si compound other than SiN so long as it satisfactorily prevents release of the hydrophobic insulating film. Also, any suitable material other than such Si compounds may be used for this purpose.

As can be seen from the foregoing, the luminous element of the present invention is so constructed that the non-luminous section thereof on which electrons are impinged but which does not contribute to luminescence is provided with a hydrophobic property, to thereby prevent gas such as oxygen or the like from being discharged from the non-luminous section even when electrons are impinged thereon, resulting in minimizing adsorption of gas on the emitter cones. Thus, the present invention minimizes deterioration in emission characteristics of the emitter cones, to thereby highly increase a lifetime of the electron excited luminous element.

Also, formation of the hydrophobic insulating film for providing the non-luminous section on which electrons are impinged with a hydrophobic property may be carried out in such a manner that a material such as an oxygen-containing silicon compound which exhibits satisfactory affinity for the glass substrate is interposed between the substrate and the film. This effectively prevents release or peel of the hydrophobic insulating film from the glass substrate.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An electron excited luminous element comprising:

a vacuum airtight envelope constructed of at least a cathode substrate made of glass and provided thereon with an electron emission means and an anode substrate made of glass and arranged opposite to said cathode substrate;

said anode substrate being provided thereon with stripe-like anode electrodes;

said stripe-like anode electrodes being provided thereon with phosphor layers which are excited by electrons emitted from said electron emission means;

said anode substrate having a glass exposed surface provided with a hydrophobic property.

2. An electron excited luminous element as defined in claim 1, wherein said hydrophobic property of said glass exposed surface of said anode substrate is provided by covering said glass exposed surface with a hydrophobic insulating film.

3. An electron excited luminous element comprising:

a vacuum airtight envelope constructed of at least a cathode substrate made of glass and provided thereon with an electron emission means and an anode substrate made of glass and arranged opposite to said cathode substrate;

said anode substrate being provided thereon with stripe-like anode electrodes;

said stripe-like anode electrodes being provided thereon with phosphor layers which are excited by electrons emitted from said electron emission means;

said anode substrate being provided at only a portion thereof in proximity to said anode electrodes and irradiated with electrons with a hydrophobic property.

4. An electron excited luminous element as defined in claim 3, wherein said hydrophobic property is provided by covering said portion of said anode substrate in proximity to said anode electrodes and irradiated with electrons with a hydrophobic insulating film.

5. An electron excited luminous element comprising:

a vacuum airtight envelope constructed of at least a cathode substrate made of glass and provided thereon with an electron emission means and an anode substrate made of glass and arranged opposite to said cathode substrate;

said anode substrate being provided thereon with stripe-like anode electrodes;

said stripe-like anode electrodes being provided thereon with phosphor layers which are excited by electrons emitted from said electron emission means;

said anode substrate being provided at a portion thereof other than said phosphor layers with a hydrophobic property.

6. An electron excited luminous element as defined in claim 5, wherein said hydrophobic property is provided by covering said portion of said anode substrate other than said phosphor layers with a hydrophobic insulating film.

7. An electron excited luminous element comprising:

a vacuum airtight envelope constructed of at least a cathode substrate made of glass and provided thereon with an electron emission means and an anode substrate made of glass and arranged opposite to said cathode substrate;

said anode substrate being provided thereon with stripe-like anode electrodes;

said stripe-like anode electrodes being provided thereon with phosphor layers which are excited by electrons emitted from said electron emission means;

said anode substrate being provided at a portion thereof other than said phosphor layers which is positioned in proximity to said anode electrodes and irradiated with electrons with a hydrophobic property.

8. An electron excited luminous element as defined in claim 7, wherein said hydrophobic property is provided by covering said portion of said anode substrate other than said phosphor layers which is positioned in proximity to said anode electrodes and irradiated with electrons with a hydrophobic insulating film.

9. An electron excited luminous element as defined in any one of claims 2, 4, 6 and 8, wherein said hydrophobic property is blackened.

10. An electron excited luminous element comprising:

a vacuum airtight envelope constructed of at least a cathode substrate made of glass and provided thereon with an electron emission means and an anode substrate made of glass and arranged opposite to said cathode substrate;

said anode substrate being provided thereon with stripe-like anode electrodes;

said stripe-like anode electrodes being provided thereon with phosphor layers which are excited by electrons emitted from said electron emission means;

said vacuum airtight envelope being provided on an inner surface thereof other than said anode substrate and irradiated with electrons with a hydrophobic property.

11. An electron excited luminous element as defined in claim 10, wherein said inner surface of said vacuum airtight envelope other than said anode substrate and irradiated with electrons is covered with a hydrophobic insulating film, resulting in said hydrophobic property being provided.

12. An electron excited luminous element as defined in any one of claims 2, 4, 6, 8 and 11, wherein said hydrophobic insulating film is made of a material selected from the group consisting of a nitride and a mixture containing at least a nitride.

13. An electron excited luminous element as defined in any one of claims 2, 4, 6, 8 and 11, wherein said hydrophobic insulating film is made of a material selected from the group consisting of a carbide and a mixture containing at least a carbide.

14. An electron excited luminous element as defined in any one of claims 2, 4, 6, 8 and 11, wherein said hydrophobic insulating film is made of a material selected from the group consisting of a fluoride and a mixture containing at least a fluoride.

15. An electron excited luminous element as defined in any one of claims 2, 4, 6, 8 and 11, wherein said hydrophobic insulating film has an internal layer arranged between the portion of said envelope to be provided thereon with said hydrophobic insulating film and said hydrophobic insulating film;

said internal layer being made of a material exhibiting affinity for both said portion of said envelope and said hydrophobic insulating layer.

16. An electron excited luminous element as defined in claim 15, wherein said hydrophobic insulating film is made of a mixture containing at least a nitrogen compound.

17. An electron excited luminous element as defined in claim 15, wherein said internal layer is made of an oxide of a material used for said hydrophobic insulating film.

18. An electron excited luminous element as defined in any one of claims 2, 4, 6, 8 and 11, wherein said hydrophobic insulating film is constructed into a layer structure wherein a content of a material exhibiting affinity for the portion of said envelope to be provided with said hydrophobic insulating film is decreased from an inner layer of said hydrophobic insulating film toward a surface thereof.

19. An electron excited luminous element as defined in claim 18, wherein said hydrophobic insulating layer is made of a mixture containing at least a nitrogen compound.

20. An electron excited luminous element as defined in claim 18, wherein said hydrophobic insulating layer contains at least an oxygen component, resulting in exhibiting affinity for said portion of said envelope to be provided with said hydrophobic insulating film.

21. An electron excited luminous element as defined in claim 18, wherein said hydrophobic insulating film is formed by vapor phase growth.

22. An electron excited luminous element as defined in claim 15, wherein said hydrophobic insulating film is provided on a black matrix.

23. An electron excited luminous element as defined in claim 16, wherein said internal layer is made of an oxide of a material used for said hydrophobic insulating film.

24. An electron excited luminous element as defined in claim 19, wherein said hydrophobic insulating layer contains at least an oxygen component, resulting in exhibiting affinity for said portion of said envelope to be provided with said hydrophobic insulating.

25. An electron excited luminous element as defined in claim 19, wherein said hydrophobic insulating film is formed by vapor phase growth.

26. An electron excited luminous element as defined in claim 20, wherein said hydrophobic insulating film is formed by vapor phase growth.

27. An electron excited luminous element as defined in claim 16, wherein said hydrophobic insulating film is provided on a black matrix.

28. An electron excited luminous element as defined in claim 17, wherein said hydrophobic insulating film is provided on a black matrix.

29. An electron excited luminous element as defined in claim 18, wherein said hydrophobic insulating film is provided on a black matrix.

30. An electron excited luminous element as defined in claim 19, wherein said hydrophobic insulating film is provided on a black matrix.

31. An electron excited luminous element as defined in claim 20, wherein said hydrophobic insulating film is provided on a black matrix.

32. An electron excited luminous element as defined in claim 21, wherein said hydrophobic insulating film is provided on a black matrix.

* * * * *

UNITED STATES PATENT AND TRADEMARK OFFICE

CERTIFICATE OF CORRECTION

PATENT NO. : 5,717,286
DATED : February 10, 1998
INVENTOR(S) : Itoh et al.

It is certified that error appears in the above-identified patent and that said Letters Patent is hereby corrected as shown below:

Title page,
Item [54],
Column 1,
Title of Invention should read:

-- [54] ELECTRON EXCITED LUMINOUS ELEMENT WITH AN ANODE SUBSTRATE HAVING A GLASS EXPOSED SURFACE PROVIDED WITH AN HYDROPHOBIC PROPERTY --

Signed and Sealed this

Eleventh Day of December, 2001

*Attest:*

Nicholas P. Godici

*Attesting Officer*

NICHOLAS P. GODICI
*Acting Director of the United States Patent and Trademark Office*